US005783781A

United States Patent [19]

Mengoli et al.

[11] Patent Number: 5,783,781

[45] Date of Patent: Jul. 21, 1998

[54] DEVICE FOR MODIFYING THE HEIGHT OF AN EXHAUST SILENCER OF A VEHICLE OF MOTORCYCLE TYPE FROM THE GROUND

[75] Inventors: Gianluigi Mengoli, Budrio; Franco Bilancioni, Bologna, both of Italy

[73] Assignee: Ducati Motor, S.p.A., Sondrio, Italy

[21] Appl. No.: 855,849

[22] Filed: May 12, 1997

[30] Foreign Application Priority Data

May 21, 1996 [IT] Italy ..... MI960380 U

[51] Int. Cl.[6] ..... F01N 7/18; F16L 27/00

[52] U.S. Cl. ..... 181/241; 285/184

[58] Field of Search ..... 181/241, 282; 180/296, 309; 285/184, 275, 278

[56] References Cited

U.S. PATENT DOCUMENTS

| | | | |
|---|---|---|---|
| 3,159,239 | 12/1964 | Andrews | 181/282 |
| 4,573,550 | 3/1986 | Inomata et al. | 180/296 |
| 5,069,487 | 12/1991 | Sheppard | 285/184 |
| 5,701,737 | 12/1997 | Branik et al. | 181/282 |

FOREIGN PATENT DOCUMENTS

| | | |
|---|---|---|
| 0537603 | 4/1993 | European Pat. Off. . |
| 2627543 | 8/1989 | France . |
| 607936 | 10/1948 | United Kingdom . |

OTHER PUBLICATIONS

Patent Abstracts of Japan, vol. 095, No. 009, 31 Oct. 1995 & JP 07 166859A (Yamaha Motor Co. Ltd).

Patent Abstract of Japan, vol. 095, No. 003, 28 Apr. 1995 & JP 06 336922 A (Suzuki Motor Corp).

*Primary Examiner*—Khanh Dang
*Attorney, Agent, or Firm*—Steinberg & Raskin, P.C.

[57] ABSTRACT

A device (8) for modifying the height of the discharge end (5) of an exhaust silencer (1) of a motorcycle from the ground is provided. The silencer (1) is connected at one end (6) to the terminal part (7A) of the exhaust pipe (7) of the motorcycle engine. The device (8) comprises cylindrical elements (10, 11) connected respectively to the end (6) of the silencer (1) and to the terminal part (7A) of the exhaust pipe (7), said elements (10, 11) being able to be fitted together in socket manner and being rotatable relative to each other so as to enable the discharge end (5) of the silencer (1) to be set to the desired height and to be locked in that position to the motorcycle frame.

15 Claims, 1 Drawing Sheet

DEVICE FOR MODIFYING THE HEIGHT OF AN EXHAUST SILENCER OF A VEHICLE OF MOTORCYCLE TYPE FROM THE GROUND

FIELD OF THE INVENTION

The present invention relates to a device for modifying the height of an exhaust silencer of a motorcycle from the ground.

BACKGROUND OF THE INVENTION

Variable-height exhaust silencers are used in motorcycles to allow the mounting of side bags of various dimensions.

For example, it is known to form the silencer in two portions which are connected together by a ball joint which enables an end portion of the silencer to be rotated relative to the other portion which is rigid with the engine exhaust pipe.

SUMMARY OF THE INVENTION

The above-referenced prior art device has the disadvantage that the height of the exhaust silencer can only be modified to a small extent, because part of the silencer is fixed to the exhaust pipe, which is provided in a well-defined portion of the motorcycle.

An object of the present invention is to provide an improved device for modifying the height of an exhaust silencer of a vehicle of the motorcycle type from the ground.

A particular object of the present invention is to provide a device which has a simple construction and which enables the height of the vehicle exhaust silencer from the ground to be widely varied.

These and further objects which will be apparent to one of ordinary skill the art are attained by a device in accordance with the accompanying claims.

In accordance with the present invention, a device for modifying a height of a discharge end of an exhaust silencer of a motorcycle is provided which includes a first cylindrical element for connecting to a first end of the exhaust silencer and a second cylindrical element for connecting to a terminal part of an exhaust pipe. The first and second cylindrical elements are fitted together in socket manner, and are rotatable relative to each other to enable the discharge end of the silencer to be set to a desired height, and to be locked at the desired height to a motorcycle frame.

In accordance with an embodiment of the present invention, the first cylindrical element includes a pair of coaxial cylindrical portions defining an first interspace therebetween, a portion of the second cylindrical element being received in the interspace.

In accordance with a further aspect of this embodiment, the second cylindrical element includes a second pair of coaxial cylindrical portions defining an second interspace therebetween, and one of the pair of coaxial cylindrical portions of the first cylindrical element is received in the second interspace

BRIEF DESCRIPTION OF THE DRAWINGS

The present invention will be more apparent from the accompanying drawing, which is provided by way of non-limiting example and in which.

DETAILED DESCRIPTION OF THE INVENTION

Figure 1:
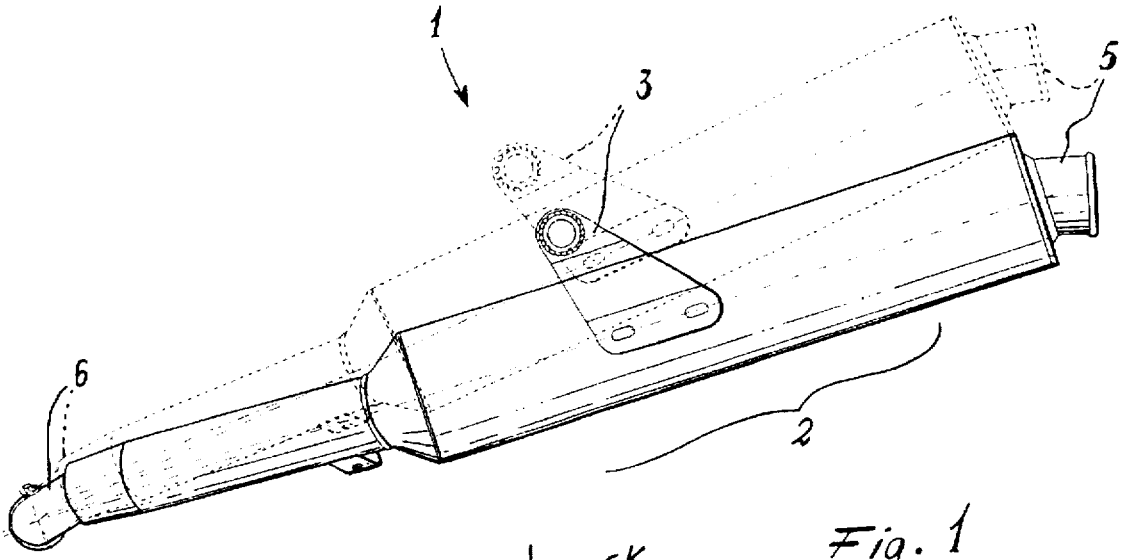
FIG. 1 is a side view of a silencer in two possible positions of use, one of which is shown by dashed lines.
Figure 2:
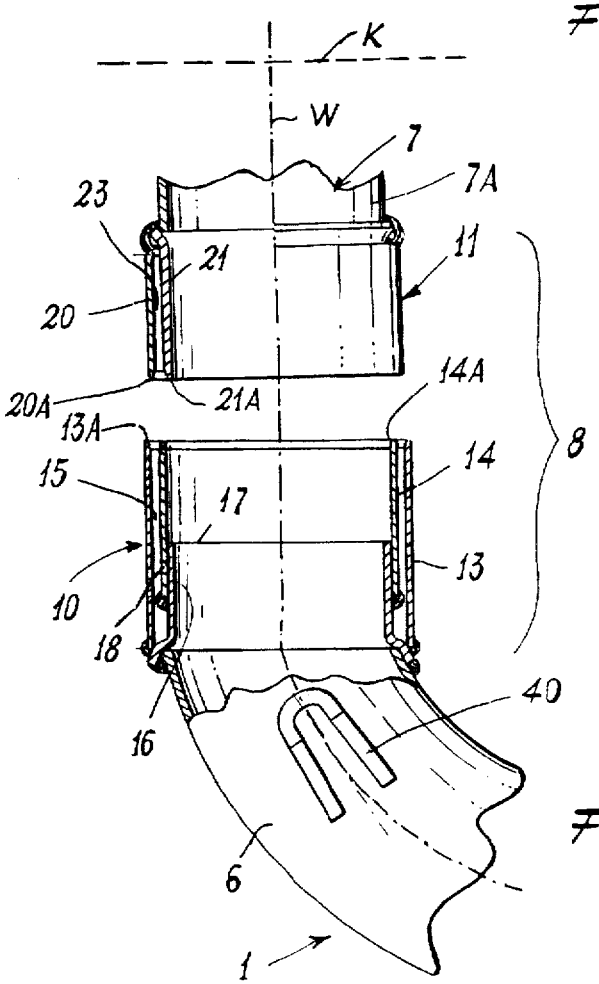
FIG. 2 is an exploded view in cross-section showing the device of the invention.

Referring to FIG. 1, an exhaust silencer 1 includes a tubular body 2 with different-diameter sections. The tubular body 2 is associated with a frame of a motorcycle (not shown) by a support bracket 3. The silencer 1 includes a discharge end 5 and an end 6, distant from the end 5. Referring to FIG. 2, the end 6 cooperates with a terminal part 7A of an exhaust pipe originating from the motorcycle engine (not shown). More specifically, the end 6 is arranged to be associated with the exhaust pipe 7 via a device 8 which enables the height of the silencer 1 (or rather of its discharge end 5) from the ground to be modified by rotating the body 2 about a longitudinal axis W of said device perpendicular to the central plane of symmetry K of the vehicle (shown schematically in FIG. 2 by a dashed line) and passing through the end 6 of the body.

In accordance with the illustrated embodiment of the present invention, the device 8 comprises a first cylindrical part 10 associated with the end 6 of the silencer 1, and a second cylindrical part 11 associated with the exhaust pipe 7. The parts 10 and 11 are able to mutually cooperate by means of an insertion fit. For this purpose, the part 10 comprises an outer first cylindrical portion 13 and an inner second cylindrical portion 14. A cavity 15 is present between these portions. The inner portion 14 is associated, in proximity to one 18 of its ends, to a third cylindrical portion 16 to which the first portion 13 is also fixed and which defines a step 17 in the interior of the part 10.

A first cylindrical portion 20 of the second part 11 of the device 8 is positionable within the cavity 15; a second cylindrical portion 21 of said part is positioned internal to the first portion 20 and with it defines a cavity 23 arranged to receive the second portion 14 of the part 10. The second portion 21 of the part 11 is arranged to abut on the step 17 within the part 10.

Preferably, the free ends 13A, 14A, 20A, 21A of the corresponding portions defining the parts 10 and 11 of the device 8 are tapered or inclined so as to facilitate the aforesaid socket fit, i.e., their mutual insertion one into the other.

After this mutual insertion, the device 8 is tight against the exhaust gases originating from the engine, and enables the height of the discharge end 5 to be modified by simply rotating said parts relative to each other. After the desired height of the end 5 has been attained, the body 2 is fixed to the motorcycle frame such as to prevent separation between the parts 10 and 11 of the device 8, or between the silencer 1 and the exhaust pipe 7.

An elastic element (not shown) is preferably hooked onto a bracket 40 present on the end 6 of the silencer 1, to cooperate with a corresponding fixing member (not shown) present on the exhaust pipe 7. This elastic element maintains the parts 10 and 1 united while adjusting the height of the silencer 1 from the ground.

What is claimed is:

1. An height adjustable exhaust silencer for a motorcycle, comprising:

a exhaust silencer having a first end and a second end;

a first mounting element attached to the exhaust silencer, the first mounting element for securing to a motorcycle frame;

an adjustment member, the adjustment member having a first cylindrical element connected to the first end of the exhaust silencer, a second cylindrical element for connecting to a terminal part of an exhaust pipe, the first and second cylindrical elements being fitted together in socket manner, the first and second cylindrical elements being rotatable relative to each other.

2. The exhaust silencer according to claim 1, further comprising a second mounting element attached to the exhaust silencer between the first mounting element and the adjustment member, an elastic element for securing to the second mounting element and to a third mounting element on an exhaust pipe.

3. The exhaust silencer according to claim 1, wherein the first cylindrical element includes a first pair of coaxial cylindrical portions defining a first space therebetween, a portion of the second cylindrical element being received in the first space.

4. The exhaust silencer according to claim 1, wherein the second cylindrical element includes a pair of coaxial cylindrical portions defining a space therebetween, a portion of the first cylindrical element being received in the space.

5. The exhaust silencer according to claim 3, wherein the second cylindrical element includes a second pair of coaxial cylindrical portions defining an second space therebetween, a portion of the first cylindrical element being received in the second space, the portion of the first cylindrical element being one of the pair of coaxial cylindrical portions of the first cylindrical element.

6. The exhaust silencer according to claim 2, wherein a step is provided in the first cylindrical portion to limit the insertion of the second cylindrical portion into the first cylindrical portion.

7. The exhaust silencer according to claim 6, wherein the step is a third cylindrical portion disposed interior to the first pair of coaxial cylindrical portions.

8. The exhaust silencer according to claim 1, wherein a longitudinal axis of the adjustment member is perpendicular to a central plane of symmetry of the vehicle.

9. A device for modifying a height of a discharge end of an exhaust silencer of a motorcycle, comprising:

a first cylindrical element for connecting to a first end of the exhaust silencer;

a second cylindrical element for connecting to a terminal part of an exhaust pipe, the first and second cylindrical elements being fitted together in socket manner, the first and second cylindrical elements being rotatable relative to each other to enable the discharge end of the silencer to be set to a desired height, and to be locked at the desired height to a motorcycle frame.

10. The device according to claim 9, wherein the first cylindrical element includes a pair of coaxial cylindrical portions defining an first interspace therebetween, a portion of the second cylindrical element being received in the interspace.

11. The device according to claim 9, wherein the second cylindrical element includes a pair of coaxial cylindrical portions defining an interspace therebetween, a portion of the first cylindrical element being received in the interspace.

12. The device according to claim 10, wherein the second cylindrical element includes a second pair of coaxial cylindrical portions defining an second interspace therebetween, a portion of the first cylindrical element being received in the interspace, the portion of the first cylindrical element being one of the pair of coaxial cylindrical portion of the first cylindrical element.

13. The device according to claim 9, wherein a step is provided in the first cylindrical portion to limit the insertion of the second cylindrical portion into the first cylindrical portion.

14. The exhaust silencer according to claim 13, wherein the step is a third cylindrical portion disposed interior to the first pair of coaxial cylindrical portions.

15. The device according to claim 9, wherein a longitudinal axis of the device is perpendicular to a central plane of symmetry of the vehicle.

* * * * *